US007964859B2

(12) United States Patent
Shayer

(10) Patent No.: US 7,964,859 B2
(45) Date of Patent: Jun. 21, 2011

(54) RADIATION-SHIELDING MATERIAL USING HYDROGEN-FILLED GLASS MICROSPHERES

(75) Inventor: Zeev Shayer, Englewood, CO (US)

(73) Assignee: Colorado Seminary, Denver, CO (US)

( * ) Notice: Subject to any disclaimer, the term of this patent is extended or adjusted under 35 U.S.C. 154(b) by 66 days.

(21) Appl. No.: 12/665,595

(22) PCT Filed: Jun. 20, 2008

(86) PCT No.: PCT/US2008/067749

§ 371 (c)(1),
(2), (4) Date: Dec. 18, 2009

(87) PCT Pub. No.: WO2008/157794

PCT Pub. Date: Dec. 24, 2008

(65) Prior Publication Data

US 2010/0176316 A1 Jul. 15, 2010

Related U.S. Application Data

(60) Provisional application No. 60/945,387, filed on Jun. 21, 2007.

(51) Int. Cl.
*G21F 1/00* (2006.01)

(52) U.S. Cl. ..... 250/515.1

(58) Field of Classification Search ..... 250/515.1
See application file for complete search history.

(56) References Cited

U.S. PATENT DOCUMENTS 5,786,785 A 7/1998 Gindrup
5,840,800 A * 11/1998 Joffre et al. ..... 524/806
6,960,311 B1 11/2005 Mirsky
7,194,060 B2 3/2007 Ohsono

FOREIGN PATENT DOCUMENTS

WO WO 2005/001845 A2 1/2005

* cited by examiner

*Primary Examiner* — Kiet T Nguyen
(74) *Attorney, Agent, or Firm* — Door, Carson & Birney, P.C.

(57) ABSTRACT

A radiation-shielding material is made of hydrogen-filed glass microspheres embedded within a suitable binder and held within a suitable support structure. The shielding material can be customized to various radiation field environments by adding a metallic coating to the microspheres or adding metal to the binder. In addition, the microspheres can be filled with a combination of gases or supplemented by other microspheres filled with different gases to meet specific radiation shielding requirements.

12 Claims, 11 Drawing Sheets

RADIATION-SHIELDING MATERIAL USING HYDROGEN-FILLED GLASS MICROSPHERES

RELATED APPLICATIONS

This application is a U.S. national filing under 35 U.S.C. 371 and claims the benefit of PCT International Patent Application Ser. No. PCT/US2008/067749 filed Jun. 20, 2008, which was published under PCT Article 21(2) in English and which claims priority to U.S. Provisional Patent Application Ser. No. 60/945,387 filed Jun. 21, 2007, both of which are incorporated herein by reference.

BACKGROUND OF THE INVENTION

1. Field of the Invention

The present invention relates generally to the field of radiation-shielding materials. More specifically, the present invention discloses a radiation-shielding material using hydrogen-filled glass microspheres that can optionally be supplemented with metallic microspheres or powder, or solid glass microspheres.

2. Background

The effectiveness of a radiation-shielding material is characterized by its ability to absorb the energy of highly-energetic particles within the shield material and to minimize generation of secondary particles that may deteriorate the radiological and electronic system performance situation. It is well known that hydrogen is a very effective element for absorbing high-energy particles with minimum secondary particle effects. Therefore an effective radiation-shielding material can be made by incorporating high concentrations of hydrogen. But, these materials often lack other properties required for structural integrity and gamma ray attenuation. Various multifunctional candidate materials have been suggested and studied in the past by NASA, such as the possibility of using liquid hydrogen and methane as radiation protection and fuel materials simultaneously.

In addition, glass microspheres filled with hydrogen are one of the promising technologies proposed for hydrogen storage as an energy source for various applications. Lithium hydride has been proposed for use as a shielding material for nuclear propulsion spacecraft. Various forms of polymeric materials have been suggested such as polyethylene, and polysulfone and polyetherimide. These materials also show good structural integrity. Graphite nanofibers heavily impregnated with hydrogen may become viable in the future, and represent multifunctional space structural materials. Finally, aluminum has long been used as a spacecraft material and vast of experience has been accumulated in using this material as a structural material for spacecraft and radiation-protection boxes for electronic equipment.

The present invention combines elements from the prior art, as discussed above, by employing glass microspheres filled with high-pressure hydrogen gas as a radiation-shielding material. The microspheres can be embedded within a suitable structural skeleton (e.g., aluminum) with a suitable binder. This shielding material can be readily customized to various radiation field environments by adding different metals to the microspheres, such as lead, tantalum, or tungsten. In addition, metal powder, metal microspheres or solid glass microspheres can be included. The microspheres can also be filled with a combination of gases, or supplemented by other microspheres filled with different gases, such as helium-3, which has very high absorption cross-section for neutrons.

The fraction of these microspheres within a structure can be selected for specific radiation field and radiation protection requirements.

SUMMARY OF THE INVENTION

This invention provides a radiation-shielding material made of hydrogen-filled glass microspheres. The microspheres can be embedded within a suitable binder held within a suitable structural skeleton, or laminated between layers in a composite structure. The shielding material can be customized to various radiation field environments by adding different metals to the microspheres or binder, such as lead, tantalum, or tungsten. In addition, the microspheres can be filled with a combination of gases, or supplemented by other microspheres filled with different gases to meet specific radiation shielding requirements.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
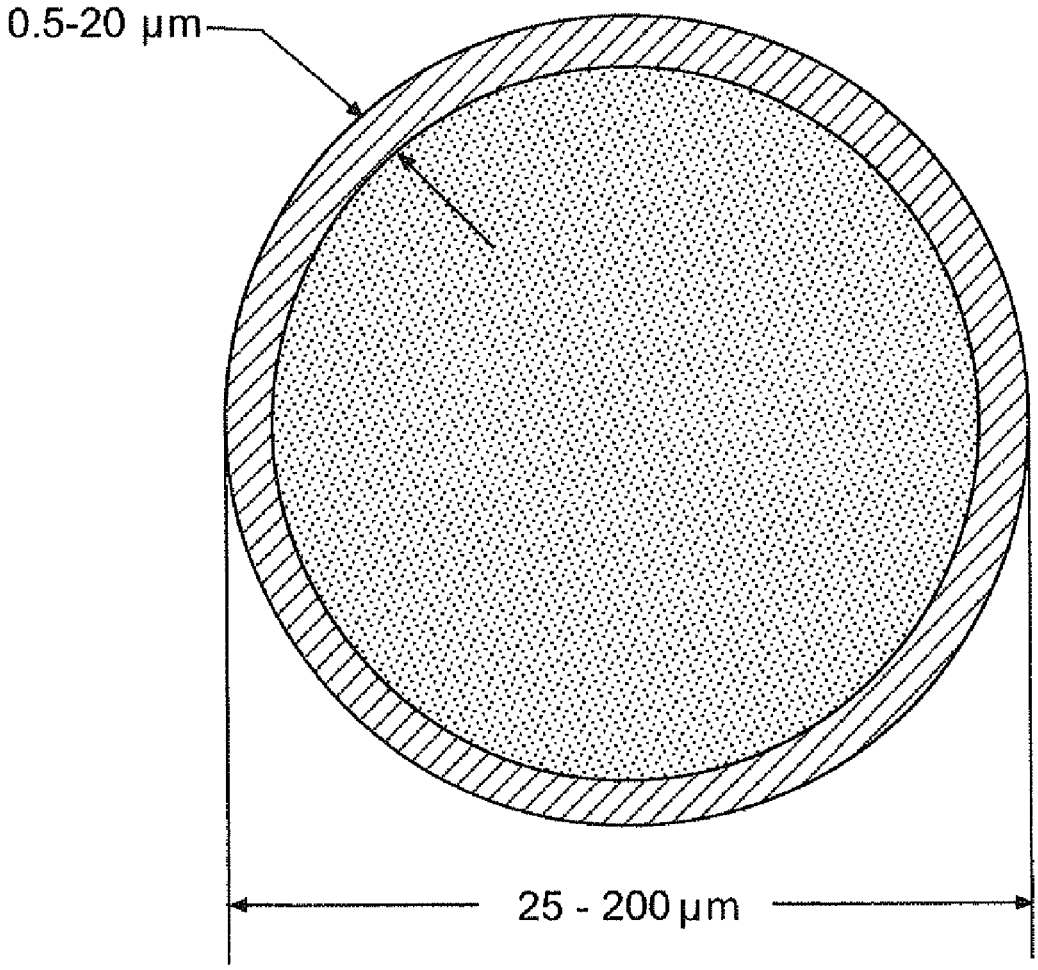
FIG. 1 is a schematic cross-sectional view of a glass microsphere.

Hollow glass microspheres are commercially-produced and have been studied since the late 1970's for use in storing hydrogen as a fuel, as previously noted. Typical microspheres are between 5 and 200 μm in diameter, have wall thicknesses of 0.5 to 20 μm and can be filled with up to 100 MPa of hydrogen. FIG. 1 is schematic cross-sectional representation of a hollow glass microsphere. Several properties are important for the suitability of such micrometric hollow spheres for hydrogen storage. First, the spherical shape should be as perfect as possible. Deviations can lead to a decrease in its ability to withstand pressure differences and, hence, to a lower hydrogen storage density. Second, the spheres should to be made from materials with high tensile strength, which determines the maximum loading pressure for a given geometry of the sphere and, ultimately, the maximum volumetric storage density achievable. Third, the permeability of the material and its temperature dependence determines the filling and hold time of the material.

Figure 2:
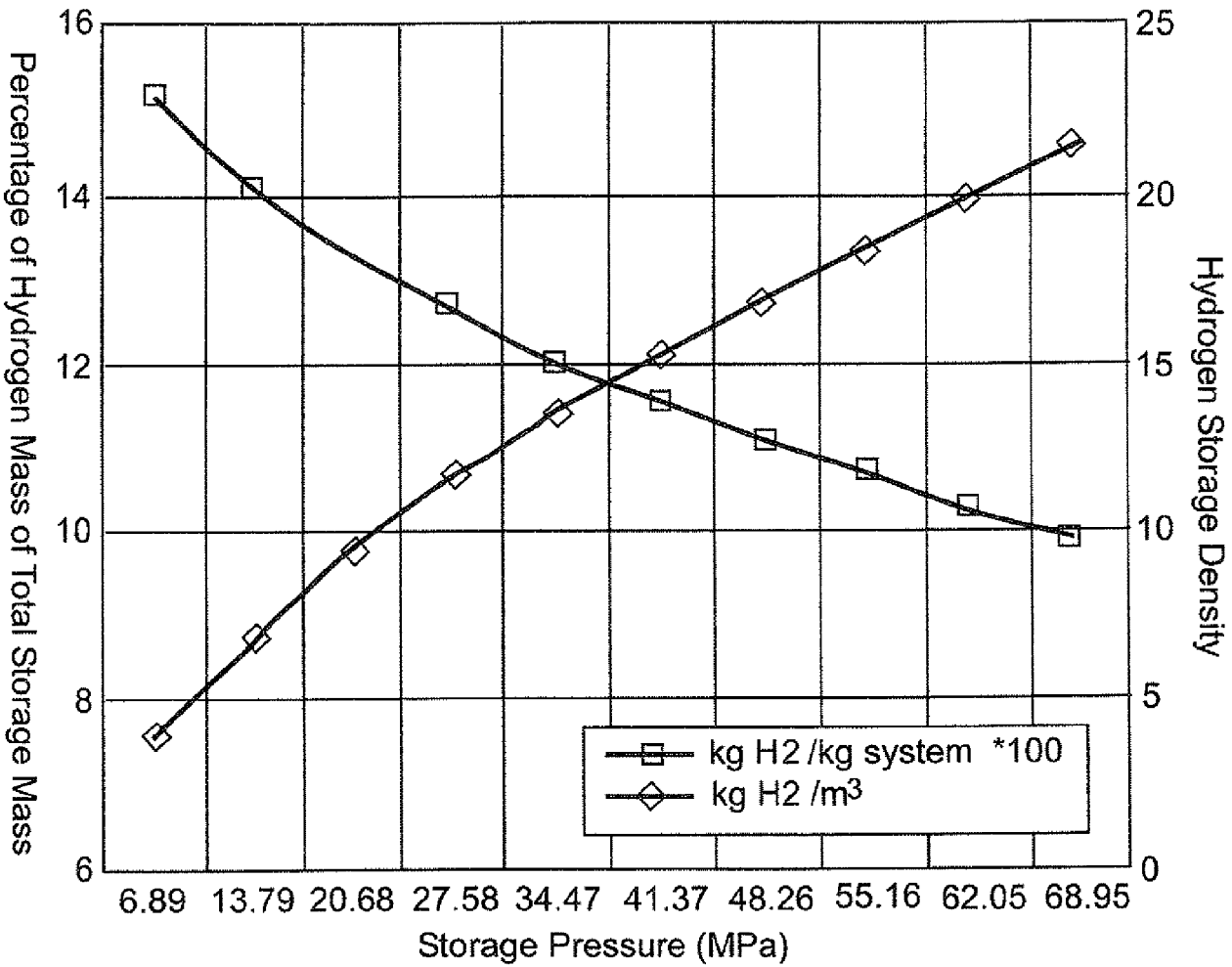
FIG. 2 is a graph showing the hydrogen mass fraction and volumetric density as a function of storage pressure in glass microspheres.

The filling process of hydrogen is relatively simple. Heating the spheres increases their permeability to hydrogen. This provides the ability to fill the spheres by placing the warmed spheres in a high-pressure hydrogen environment. The hoop stresses achievable for glass microspheres can range from 345 MPa (50,000 psi) to 1,034 MPa (150,000 psi). Once cooled, the spheres lock the hydrogen inside. The fill rates of microspheres are related to the properties of the glass used to construct the spheres, and depend on the temperature at which the gas is absorbed (usually between 150° C. and 400° C.) and the pressure of the gas during absorption process. Fill rates are directly proportional to the permeability of the glass spheres to hydrogen which increases with increasing temperature. At 225° C., it is approximately 1 hour, and at 300° C., it is approximately 15 minutes. This dramatic increase in hydrogen permeability with temperature allows the microspheres to maintain low hydrogen losses at storage conditions while providing sufficient hydrogen flow when needed. Engineered microspheres provide the greatest advantage for high density storage of hydrogen. It is estimated that a bed of 50 μm diameter microspheres can store hydrogen at 62 MPa (9000 psi) with a safety factor of 1.5 and a hydrogen mass fraction of 10%. This produces a hydrogen density of 20 $kg/m^3$. FIG. 2 is a graph showing how the hydrogen mass fraction and volumetric density change for various storage pressures.

In contrast to using glass microspheres for hydrogen storage, the present invention would typically seek to hold the hydrogen gas inside the microspheres for very long times. To avoid hydrogen off-gassing problems for space applications, the microspheres can be coated with a microscopic layer of metal or silicon-carbide/pyrolytic-carbon.

Figure 3:
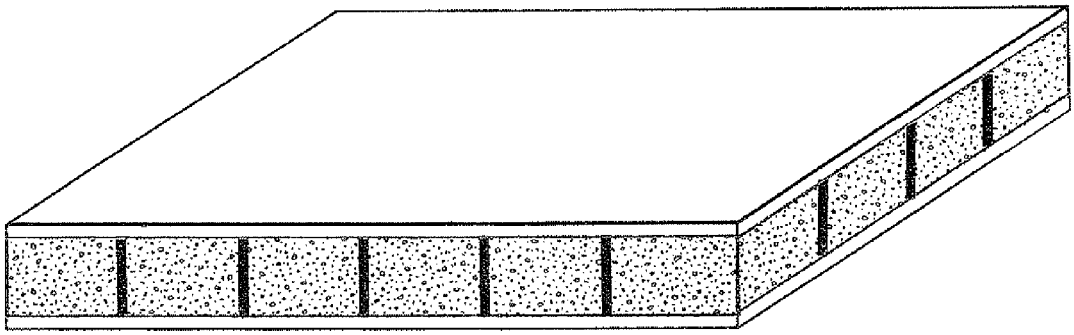
FIG. 3 is a perspective view of a section of radiation-shielding material fabricated using the cast sheet approach.

In the present invention, the hydrogen-filed glass microspheres are dispersed and embedded in a suitable binder (e.g., a polymer, such as epoxy). A support structure provides the required structural support and rigidity for the binder and microspheres. For example, the support structure can take the form of sheets or a skeleton structure made of aluminum or other metals. The radiation-shielding material can be fabricated using any of a wide variety of techniques, including the following:

Cast Sheets—Process a slurry mixture of microspheres and binder (e.g., epoxy), and cast into sheets of a desired thickness. Using a compliant, thermally-conductive adhesive, the cast sheets can be bonded to a composite or metallic substrate, or sandwiched between substrate layers for support. For example, a cast sheet can be sandwiched between thin layers of aluminum. FIG. 3 illustrates a radiation-shielding material fabricated using the cast sheet approach. The over-all thickness of the composite can be optimized to satisfy specified radiation dosage limitations. In addition, multiple cast sheets can be stacked together or stacked with alternating layers of other materials (e.g., aluminum) to achieve desired properties.

Figure 4:
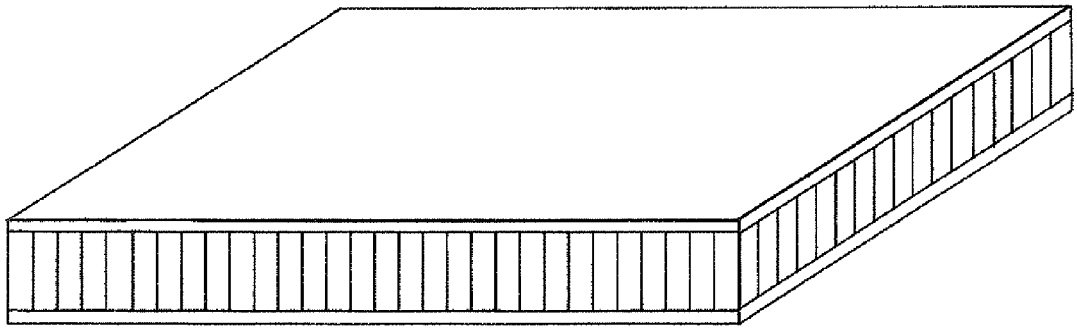
FIG. 4 is a perspective view of a panel fabricated using a honeycomb-core filled with slurry of hydrogen-filled glass microspheres and a binder.

Composite Enclosure—A lightweight enclosure with radiation-shielding attributes can be fabricated using a composite sandwich panel design. For example, a honeycomb core structure can be bonded to a composite or metallic face sheet. A slurry of microspheres and binder can be poured into the exposed cells of the honeycomb core, thus producing a radiation-shielding core structure. Subsequently, a top face sheet (e.g., aluminum) can be bonded to the top to complete the assembly of the panel. Such a composite design produces a multifunctional panel, which offers a suitable combination of radiation shielding, stiffness, strength, and EMI shielding for electronic enclosures. FIG. 4 illustrates a panel fabricated using a honeycomb-core filled with such a slurry.

Figure 5:
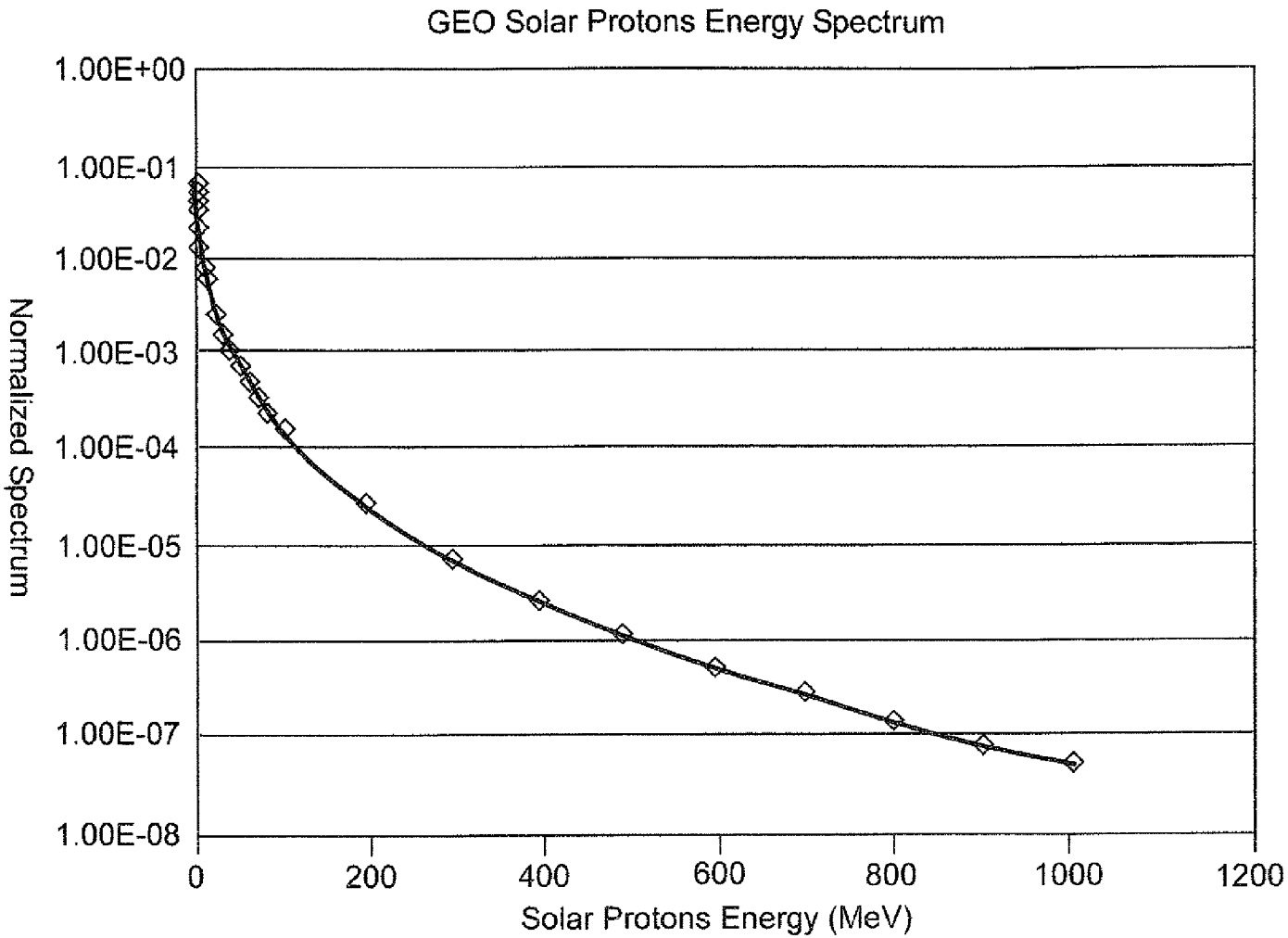
FIG. 5 is a graph of the energy spectrum of a GEO solar proton beam typically encountered in interplanetary space missions.

The fundamental qualities of interest in applications for space radiation shielding are the attenuation properties of the material against hostile high-energy charged particles (mainly, protons and electrons) and the production of secondary particles (namely, the number of neutrons and photons produced per proton particle incident on shielded or constructed materials). Simulations were conducted to demonstrate the shielding effectiveness of the new material compared with aluminum, which is a common material used for boxes to protect electronic equipment and shield humans in spacecraft. The analyses were performed by using MCNPX code. The geometry consists of a simple rectangular parallelepiped plate, 10×10 cm in various depths. A GEO solar proton beam typical for interplanetary space missions with the energy spectrum given in FIG. 5 is launched onto the shielding target. The new material is simulated as a homogenized structure with the volume percentage of 70%, 20% and 10% of $H_2$, glass and aluminum, respectively. The glass is assumed to be made of $SiO_2$ for simplicity of calculations (90% or more of the most common glasses are made of $SiO_2$). The hydrogen density encapsulated in microspheres glass is assumed to be 0.01 $g/cm^3$, which is practically and cheaply achieved with current available fabrication technology. The glass and aluminum densities are 2.23 $g/cm^3$ and 2.7 $g/cm^3$, respectively.

Figure 6:
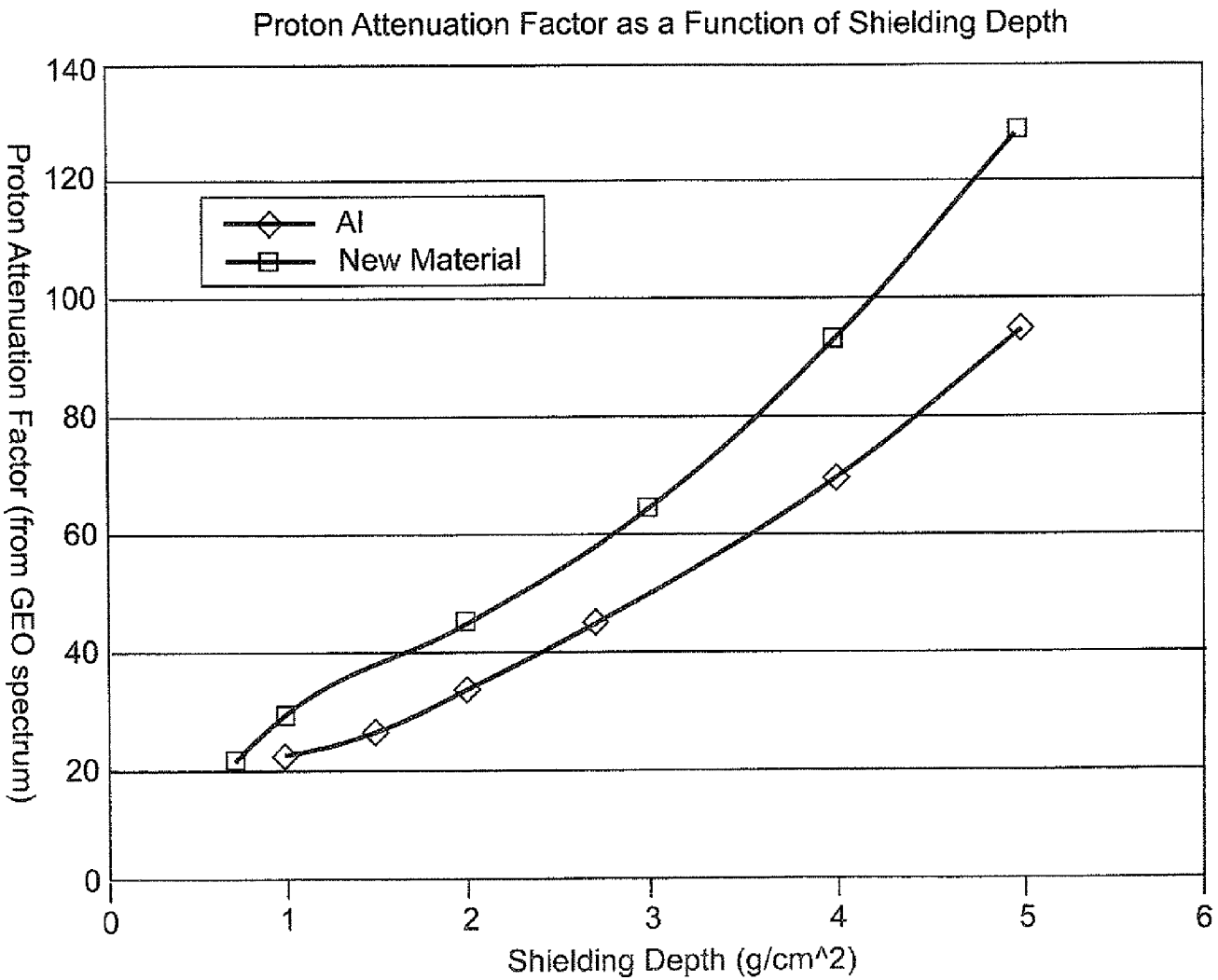
FIG. 6 is a graph showing the proton attenuation properties of the new material compared to aluminum as a function of shielding depth.

FIG. 6 shows a comparison of the proton attenuation properties of the new material compared to aluminum as a function of shielding depth (or area density). As can be seen from this figure, the new material reduces the total number of transmitted protons by 30%-40% in comparison to aluminum. In other words, the new material should allow a corresponding mass weight savings in a space mission by the same percentage, in comparison to conventional aluminum shielding.

Figure 7:
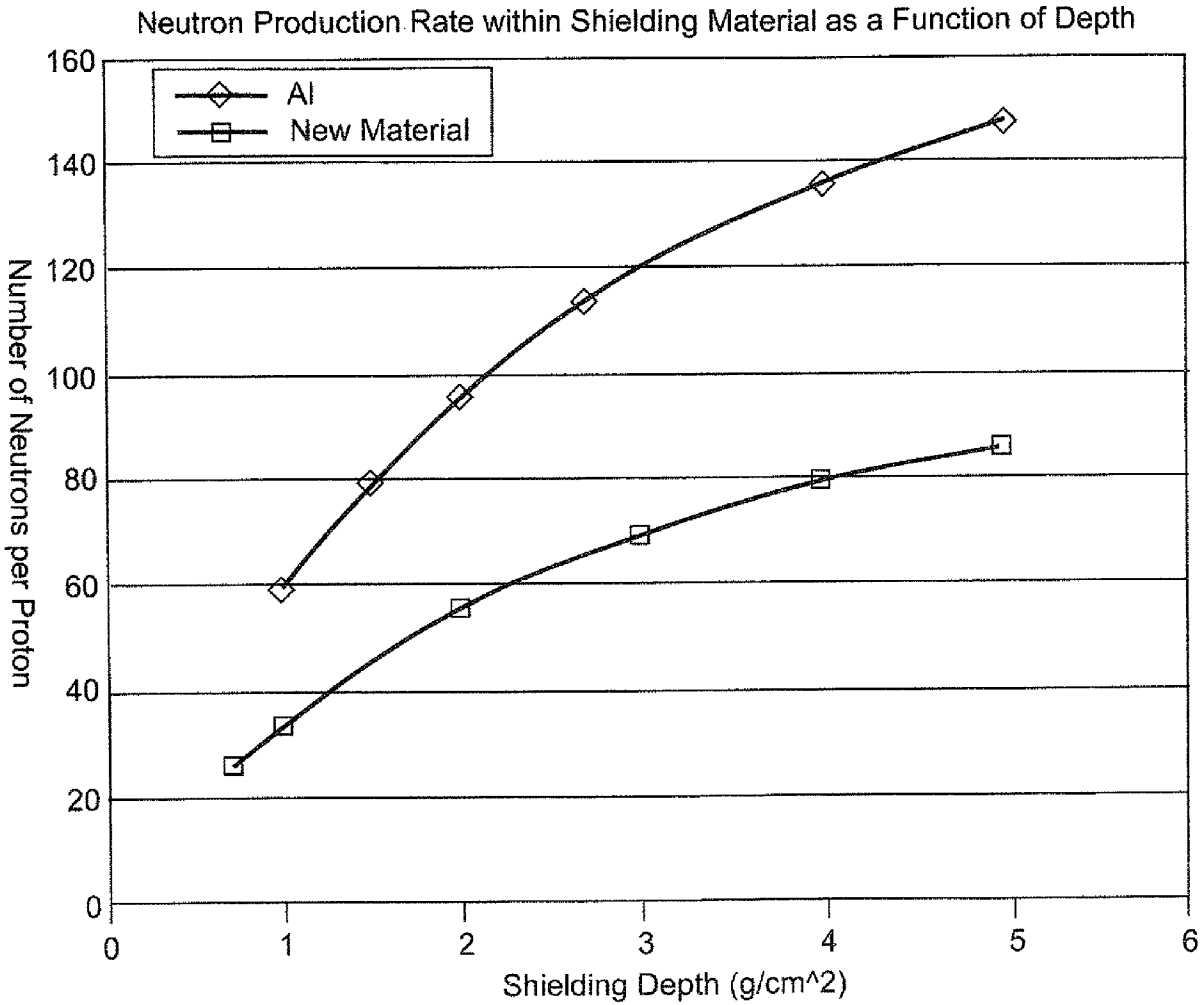
FIG. 7 is a graph depicting the number of neutrons produced per solar GEO proton hitting the new shielding material compared to aluminum.

FIG. 7 is a graph depicting the number of neutrons produced per solar GEO proton hitting the shielding material. The figure shows net neutron production resulting from nuclear interactions (the component that accounts for neutron production by all particles transported using INC/Preequilibrium/Evaporation physics) and net production by (n,xn) reactions (neutrons created in inelastic nuclear interactions by neutrons below the transition energy, using evaluated nuclear data). The data in this figure are normalized to $10^6$ protons. To calculate the number of neutrons produced for each proton hitting the shielding material, the data in the figure should be divided by $10^6$. The neutron production rate increases as the thickness of the material is increased, and for the same a real density is about a factor of two less than for aluminum.

Figure 8:
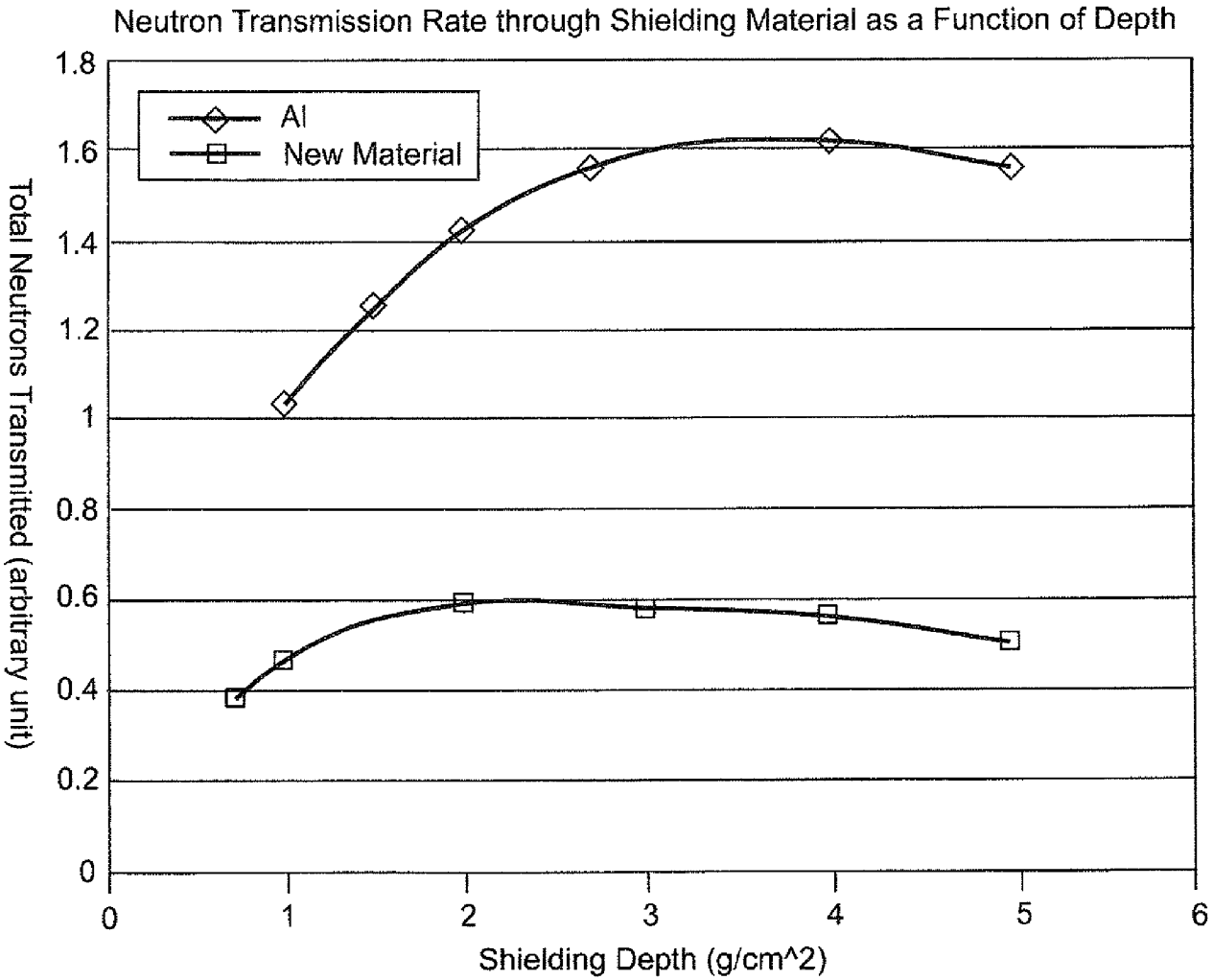
FIG. 8 is a graph showing the number of neutrons transmitted through the new shielding material as a function of depth compared to aluminum.

FIG. 8 shows the number of neutrons transmitted through the shielding material as a function of depth. The maximum neutron transmission rate in the new material occurs at a shielding depth of about 2 g/cm$^2$ as compare to 4 g/cm$^2$ for aluminum. These peaks values result from the balance between the production and attenuation rates of the neutrons within the shielding materials as a function of depth. From a certain thickness, the neutron attenuation rate becomes a more dominant factor, and therefore the neutron transmission rate starts to decline. The new shielding material transmitted by factors of 3-4 less neutrons than aluminum, which have a significant impact on damage rate reduction to the biological and electronic systems due to secondary particle cascade. The neutron particles are the primary source of radiation damage, due to atomic displacement.

Figure 9:
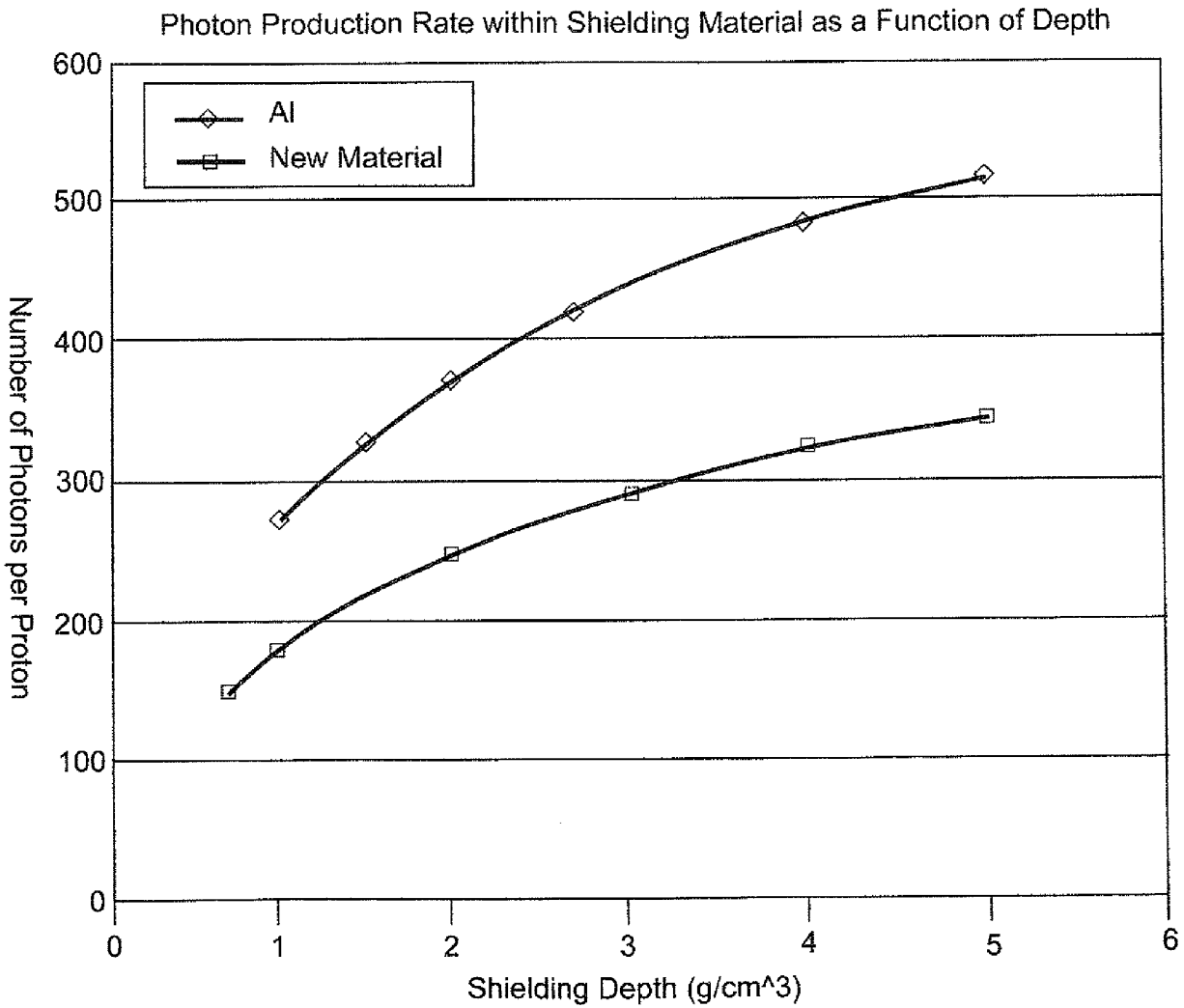
FIG. 9 is a graph showing the number of photons produced per solar GEO proton hitting the new shielding material compared to aluminum.
Figure 10:
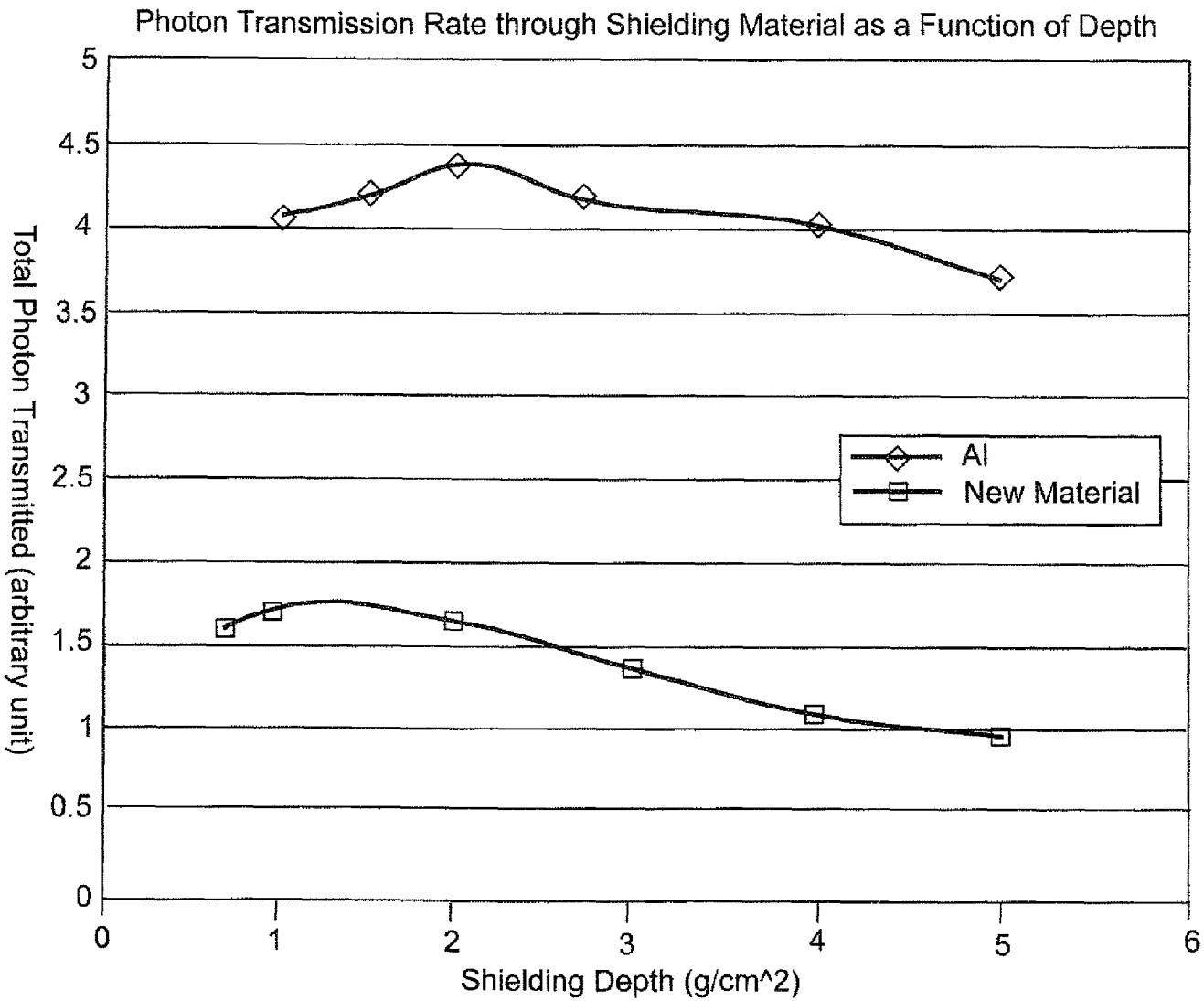
FIG. 10 is a graph showing the number of photons transmitted through the new shielding material as function of depth compared to aluminum.

FIG. 9 depicted the number of photons produced per solar GEO proton hitting the shielding material and FIG. 10 shows the number of photons transmitted through the shielding material as function of depth. These figures indicate that there is about a 50% reduction in the number of photons produced in the new material in comparison to aluminum, and about a factor of 3-4 fewer photons transmitted through the new material. The maximum photon transmission rate in the new shielding material occurred at a shielding depth of about 1 g/cm$^2$ as compare to 2 g/cm$^2$ for aluminum. These peak values are the balance between the production and attenuation rates of photons within the shielding materials as a function of depth. At certain thicknesses, the photon attenuation rate begins to prevail, and therefore the transmission rate decreases. The data in these figures are also normalized to $10^6$ protons. These calculations show that the transmitting peak for neutrons and photons in the new material occur by factor of two less than in aluminum, which indicates that with proper design it is possible to reduce mass by same factor.

Figure 11:
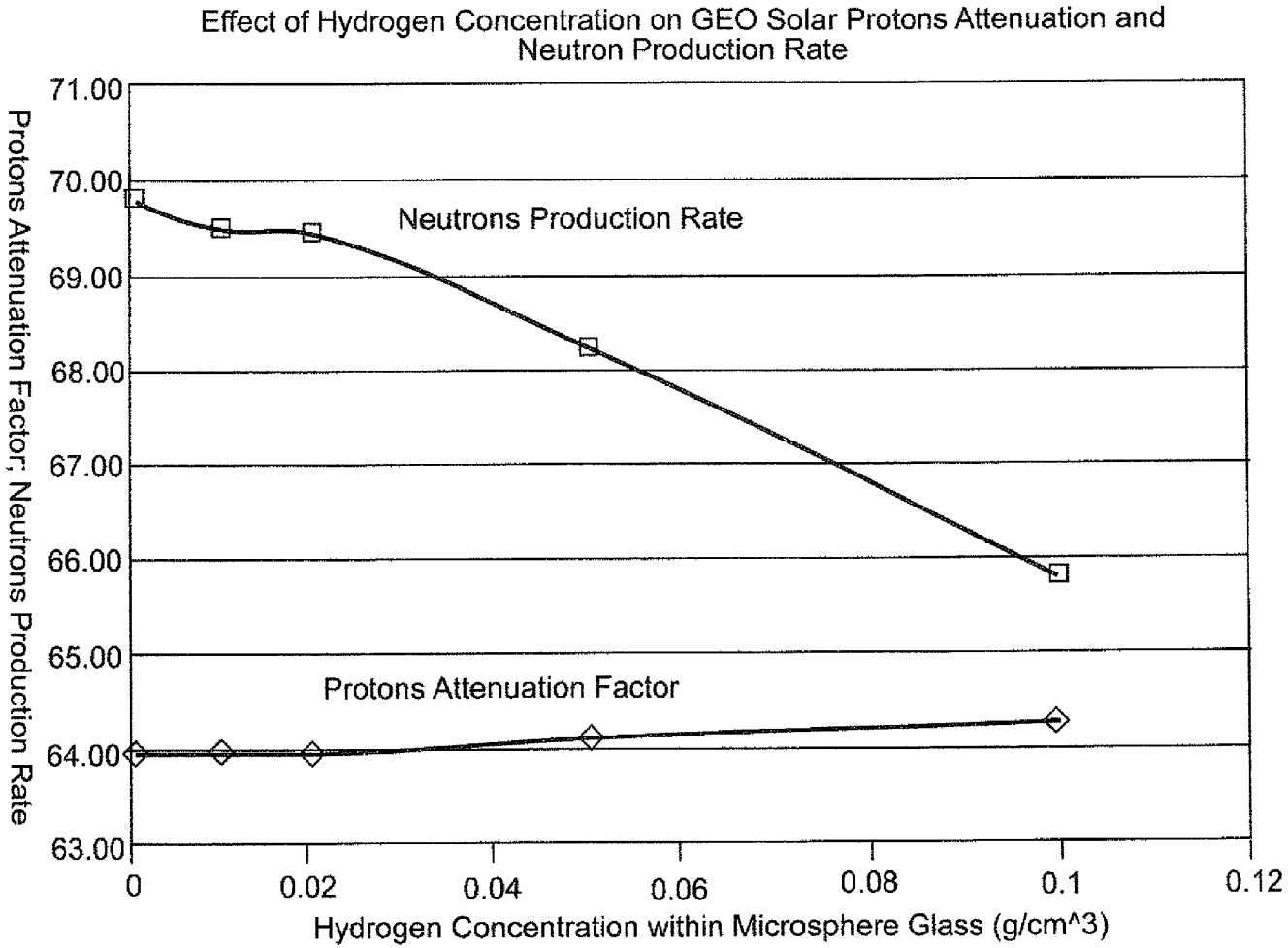
FIG. 11 is a graph showing the effect of hydrogen concentration inside the glass microsphere on the attenuation property for GEO solar protons and on the neutron production rate inside the material.

A sensitivity analysis of the radiation properties of the new material to changes in hydrogen concentration and aluminum skeleton structure volume fraction was performed to assess the impact of these parameters on the effectiveness of the material to reduce the secondary particles production rate and to decrease the number of high-energy charged particles to penetrate through the shielding material. FIG. 11 shows the effect of hydrogen concentration inside the glass microsphere on the attenuation property for GEO solar protons and on the neutron production rate inside the material. The results indicate that hydrogen concentration has a relatively small impact on proton attenuation at this range of hydrogen concentrations, but it reduces the neutron production rate by a couple of percentage points as the concentration of hydrogen increases. The higher hydrogen concentration also tends to soften the neutron spectrum which can considerably reduce the damage rates to biological and electrical systems, because most of the atomic displacement occurred in high energetic neutrons. A similar reduction in the photon production rate is also observed.

Figure 12:
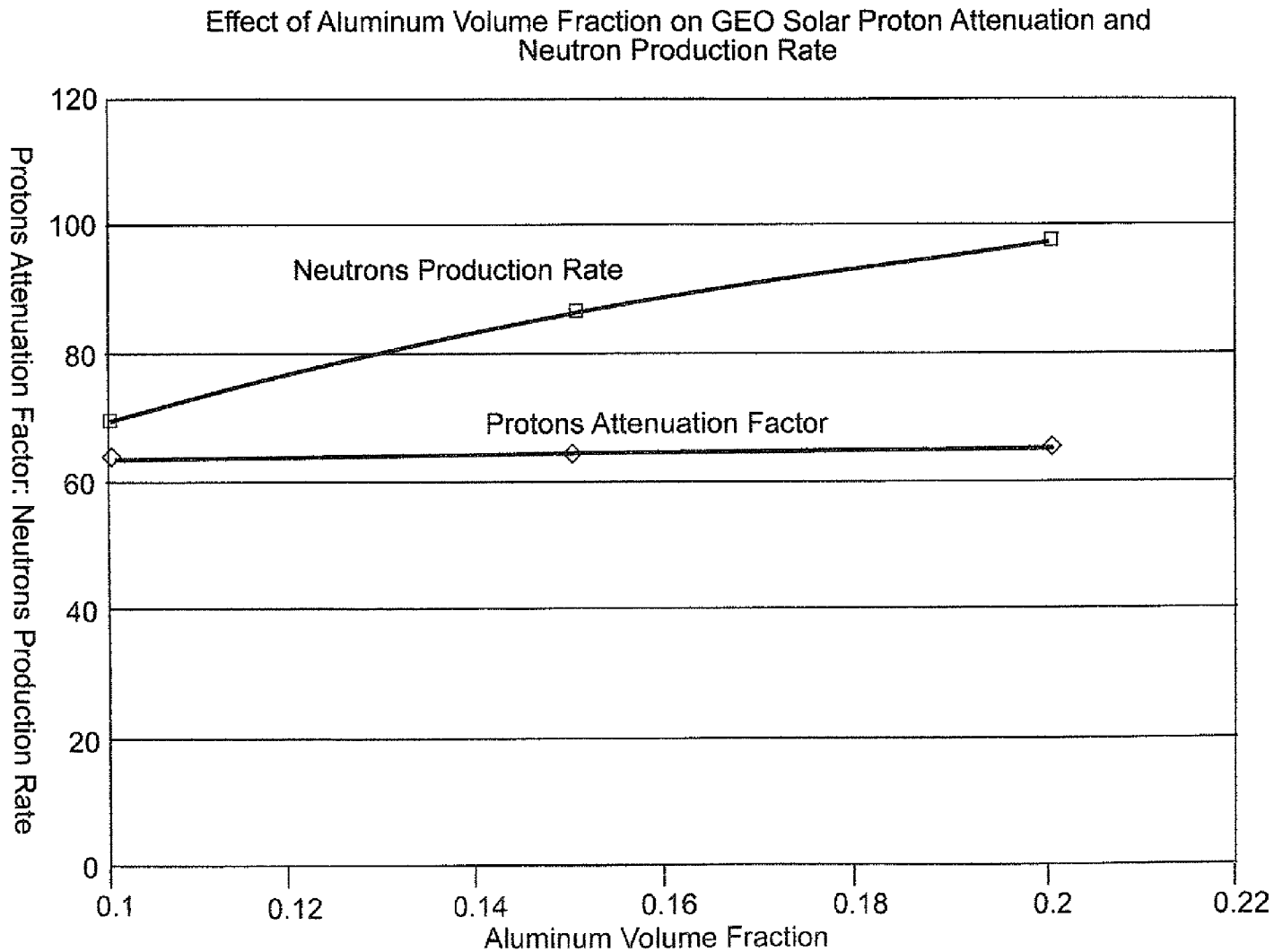
FIG. 12 is a graph showing the effect of increasing the aluminum volume fraction of the skeleton structure that hosts the microspheres on GEO solar proton attenuation and the neutron production rate.

FIG. 12 shows the effect of increasing the aluminum volume fraction of the skeleton structure that hosts the hydrogen microspheres. Increasing the aluminum volume fraction by a factor of two, from 10% to 20% has almost no impact on the GEO solar proton attenuation properties, but increases significantly the neutron production rate within the shielding material by about 30%. A similar increase in the photon production rate is also observed. These secondary particles production rates are still significantly lower than that of aluminum only. All the sensitivities calculations were performed for a shielding depth of 3 g/cm$^2$.

In summary, the new material offers a number of improvement over current radiation-shielding materials used for space applications. For example, the new material offers significant mass savings with better radiation protection, and can be fabricated with established techniques from cheap, plentiful raw materials including recycling glass. The projected strength will be not far from that of aluminum alloy, which is a commonly used material in space applications. Preliminary results show that the new material is about 30% to 40% better than aluminum in protecting the crew and electronic instruments from high-energy protons and ions. In addition, the new material reduces significantly the secondary radiation and background effects (bremsstrahlung, neutrons and gamma rays) produced inside the shielding materials (by factors of 3 to 4 and more). The hydrogen concentration within the microspheres can be adjusted to different radiation environments, and shielding mass-saving requirements. It is also possible to use different combination of gases and metals to adjust the material for specific mission (radiation environments) and radiation protection requirements. For example, if neutrons are the main particles of concern, it is possible to add microspheres filled with helium-3, which has a high neutron absorption cross-section, and still keep the material very light. Addition of high-Z metals (e.g., lead, tantalum, or tungsten) in metallic coatings to the microspheres or dispersed in the binder is also an option if enhanced radiation protection is required. Finally, the present invention opens the opportunity to move toward the use of more commercial electronic components in space, which are not specially radiation-hardened, This has the potential to significantly reduce the overall cost of spacecraft missions.

In summary, the present material is a super-lightweight composite with high performance radiation protection and thermal properties. It can be used as a multifunction, flexible material and would easily adopt for various space-mission requirements. Although the preceding discussion has focused radiation shielding in space applications, it should be understood that the present invention could also be used in shielding computers and electronics on earth. The present invention could also be employed in protective clothing used by rescue personnel, medical technicians, military personnel, or workers in hazardous work environments.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A radiation-shielding material comprising:

hollow glass microspheres containing hydrogen embedded within a binder; and a support structure supporting the binder and microspheres.

2. The radiation-shielding material of claim 1 wherein at least one of the microspheres further comprises a metallic coating.

3. The radiation-shielding material of claim 1 wherein at least one of the microspheres is at least partially filled with helium-3.

4. The radiation-shielding material of claim 1 further comprising a metal powder dispersed in the binder.

5. The radiation-shielding material of claim 1 further comprising metal microspheres dispersed in the binder.

6. The radiation-shielding material of claim 1 further comprising solid glass microspheres dispersed in the binder.

7. A radiation-shielding material comprising:

a cast sheet of hollow glass microspheres containing hydrogen embedded within a binder; and a substrate layer supporting the cast sheet.

8. The radiation-shielding material of claim 7 wherein the substrate layer comprises aluminum.

9. The radiation-shielding material of claim 7 wherein the binder comprises epoxy.

10. A radiation-shielding material comprising:

a support structure having a honeycomb core structure sandwiched between two face sheets; and hollow glass microspheres containing hydrogen embedded within a binder filling the honeycomb core structure.

11. The radiation-shielding material of claim 10 wherein the face sheets comprise aluminum.

12. The radiation-shielding material of claim 10 wherein the face sheets comprise a composite material.

* * * * *